United States Patent [19]

Jacob

[11] Patent Number: 4,746,416

[45] Date of Patent: May 24, 1988

[54] HANGER FOR USE IN ELECTROCOATING

[75] Inventor: Ronald G. Jacob, Watertown, Wis.

[73] Assignee: Western Industries Inc., Milwaukee, Wis.

[21] Appl. No.: 837,419

[22] Filed: Mar. 7, 1986

[51] Int. Cl.[4] ..... C25D 17/06; C25D 17/05; B05C 13/00; B05C 3/00

[52] U.S. Cl. ..... 204/297 W; 204/180.7; 204/297 R; 204/299 EC; 204/300 EC; 118/500; 118/428

[58] Field of Search .... 204/297 W, 299 EC, 300 EC, 204/180.2, 180.7, 297 R, 222, 225, 202; 118/500, 427, 428, 425

[56] References Cited

U.S. PATENT DOCUMENTS

| | | | |
|---|---|---|---|
| 2,462,197 | 2/1949 | Jernstedt | 204/202 |
| 3,901,788 | 8/1975 | Schaer | 204/297 W |
| 4,097,359 | 6/1978 | Davitz | 204/297 W |

*Primary Examiner*—John F. Niebling
*Assistant Examiner*—John S. Starsiak, Jr.
*Attorney, Agent, or Firm*—Foley & Lardner

[57] ABSTRACT

The invention provides a hanger for use in electropainting which solves the problem of removing trapped air bubbles from workpieces which, due to their shape, tend to retain air when lowered into a paint bath. The hanger according to the present invention includes two frames which can slide relative to one another. Workpieces to be painted are supported between the two frames, so that movement of one frame relative to the other effectively tilts the workpieces and eliminates the trapped air while the workpieces are submerged in the paint bath. For this purpose, a flotation tank can be attached to one of the frames so that the act of lowering that hanger into the paint bath causes the desired relative movement of the two frames and tilts the workpieces.

10 Claims, 3 Drawing Sheets

HANGER FOR USE IN ELECTROCOATING

FIELD OF THE INVENTION

This invention relates to a hanger for supporting one or more workpieces. More particularly, the hanger according to the present invention is useful in electropainting because it can eliminate trapped air bubbles from submerged workpieces.

BACKGROUND OF THE INVENTION

A variety of hangers have been employed to support workpieces such as automotive parts in electrocoating processes. In a typical electrocoating procedure, one or more workpieces made of an electrically conductive metal are suspended on an electrically conductive hanger lowered into a bath containing a charged paint. An electrical current is caused to flow through the hanger and workpieces so that the charged paint adheres strongly and coats the workpieces. After the workpieces have been dipped in the charged paint for a suitable time, they are rinsed to recover unused paint, and then dried at an elevated temperature. The hanger or rack used in such a conventional electrocoating process typically comprises a support frame having a number of arms (pins) or hooks mounted thereto for supporting a number of workpieces. Such a hanger is typically lowered gradually into the charged paint bath while being conveyed horizontally by an overhead conveyor system.

Workpieces of certain peculiar shapes present problems during electrocoating. For example, a cylindrical can is particularly difficult to hang in a position suitable for electropainting. If the can is hung so that it tilts downwardly (relative to the horizontal) there will be an air pocket inside the can when it is lowered into the paint bath. This will normally prevent a portion of the inner surface of the can (at the location of the air pocket) from being painted. If the can is hung on the hanger so that it tilts upwardly, an undesirable pool of paint will remain in the can after it emerges from the paint bath. If the can is held dead flat, i.e., precisely horizontal, such problems with drainage and air pockets can in theory be avoided. In practice, however, it is difficult and inconvenient to provide a hanger which holds workpieces horizontal. In some cases, even where the workpiece is held horizontal, foam spots develop on the side of the can-shaped workpiece which is lying horizontally. Such foam spots are commercially unacceptable on workpieces which are only to be coated once.

A variety of techniques have been used to solve the foregoing problems. For example, the paint bath can be sprayed into the part of the workpiece corresponding to the air pocket before the workpiece is lowered into the paint bath. Eductors or nozzles disposed in the coating tank can force the air bubble out by forcibly circulating the paint. Guide bars can also be installed in the paint bath tank to tilt (roll) the hanger in order to "burp" the air bubble out of the work piece. These methods have proven unsatisfactory in practice because they are generally not useful with a hanger for holding multiple workpieces, and also because intank modifications such as guide bars interfere with painting operations for other products of different shapes. The present invention solves the problems inherent in these known methods by incorporating means for removing a trapped air bubble into the hanger itself, as will be described hereafter.

A wide variety of systems are known for transporting treated workpieces, particularly painted or surface-treated can-shaped workpieces. Hamal U.S. Pat. No. 2,746,882 issued May 22, 1956, Dowling U.S. Pat. No. 3,365,158 issued Jan. 23, 1968, Monk U.S. Pat. No. 4,187,801 issued Feb. 12, 1980 and Oswald U.S. Pat. No. 4,213,418 issued July 22, 1980 are illustrative of such systems. Racks or hangers including a frame or support having a plurality of pins, arms or hooks for supporting objects are also widely known. The following U.S. patents are representative of such devices: Walther U.S. Pat. No. 3,252,583 issued May 24, 1966, Woorhies U.S. Pat. No. 3,642,147 issued Feb. 15, 1972, Scholl U.S. Pat. No. 3,780,875 issued Dec. 25, 1973, Lazarus U.S. Pat. No. 4,290,531 issued Sept. 22, 1981, and Turner U.S. Pat. No. 4,461,386 issued July 24, 1984. In particular, the following U.S. patents describe racks for use in electropainting wherein a plurality of hooks are mounted on a electrically conductive frame: Davitz U.S. Pat. Nos. 4,097,359 issued June 27, 1978, 4,217,853, issued Aug. 19, 1980, and 4,243,146 issued Jan. 6, 1981. None of these prior hangers and racks provide a convenient solution to the problem of electropainting workpieces which tend to capture air bubbles.

SUMMARY OF THE INVENTION

The present invention provides a hanger particularly useful in electropainting for removing trapped air bubbles from workpieces which tend to retain an air bubble when immersed in a paint bath, such as can-shaped workpieces. The hanger according to the invention has a built-in means for tilting one or more workpieces mounted thereon when the hanger is lowered into a paint bath, so that air bubbles trapped in workpieces mounted on the hanger are removed ("burped") from the workpieces.

According to one aspect of the invention, such a hanger includes a first frame by which the hanger can be lowered into the paint bath, a second frame mounted on the first frame, and means for moving the first and second frames relative to each other in order to tilt the workpieces, which are mounted on both of the first and second frames by respective support means, such as arms, pins or hooks.

According to a further aspect of the invention, a flotation device is secured to the second frame so that the second frame moves upwardly relative to the first frame when the hanger is lowered into the paint bath.

BRIEF DESCRIPTION OF THE DRAWING

A preferred exemplary enbodiment of the invention will be hereinafter described in conjunction with the appended drawing, where in like designations denote like elements, and.

DETAILED DESCRIPTION OF A PREFERRED EXEMPLARY EMBODIMENT

FIGS. 1 through 4 illustrate one embodiment of a hanger acording to the present invention. Such a hanger 10 includes a central support frame 11 having a first set of arms such as pins 12A, 12B, a first movable, e.g., slidably mounted frame 13A having a second set of arms such as support pins 14A, a second moveable, e.g. slideably mounted frame 13B having further second arms, such as support pins 14B, and a pair of flotation devices 18A, 18B secured to slidably mounted frames 13A, 13B, respectively. As will be described in detail below, hanger 10 supports a plurality of can-shaped objects (workpieces) 19.

Figure 2:
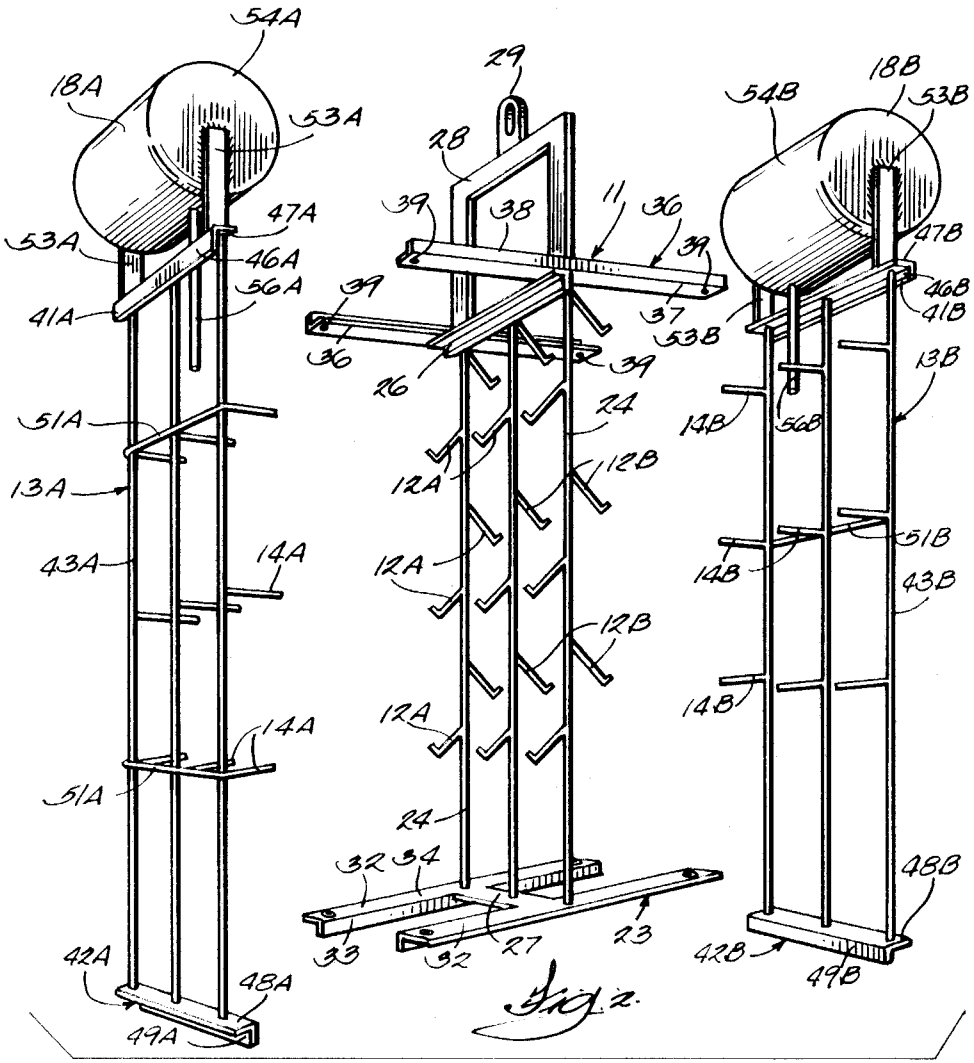
FIG. 2 is an exploded view of the hanger shown in FIG. 1.

As illustrated in FIG. 2, central frame 11 comprises a pair of upper and lower horizontal H-shaped frame sections 22, 23 rigidly connected to each other by three vertical rods 24. Upper and lower end portions of vertical rods 24 are rigidly secured, such as by welding, to upper and lower central crossbars 26, 27, respectively, of frame sections 22, 23. A C-shaped vertical frame section 28 which opens downwardly is rigidly secured to opposite ends of crossbar 26, and includes a centrally located eye 29 for engaging a hook 31 (shown in FIG. 3) of an overhead conveyor system (not shown).

Each of rods 24 has a series of outwardly extending pins 12A, 12B rigidly secured thereto at uniform intervals along the length of each rod 24. Pins 12A extend at an angle downwardly and to the left in FIG. 2 so that they oppose pins 14A on slideable frame 13A. Pins 12B extend at an angle downwardly and to the right in FIG. 2 so that they oppose pins 14B of slideable frame 13B. Pins 12A and 12B are mounted alternately along the length of each rod 24 and are aligned to define parellel, vertical and horizontal rows.

Upper H-shaped section 22 further includes a pair of transverse beams 36 centrally rigidly secured to opposite end portions of crossbar 26. Beams 36 are substantially L-shaped in cross section. More particularly, beams 36 are aligned in opposing, inwardly opening positions. Each beam 36 comprises a horizontal wall 37 and a vertical, upwardly extending wall 38. Horizontal wall 37 of each beam 36 has a pair of holes 39 through opposite end portions thereof. These holes 39 are provided so that central frame 11 may be interlocked with the slideable frames 13A, 13B during construction of hanger 10, as will be described in detail hereafter. Lower H-shaped frame section 23 is substantially identical to upper H-shaped frame section 22, except that transverse beams 32 of lower frame section 23 are disposed so that their vertical walls 33 extend downwardly from the inner edge of their horizontal walls 34, whereby beams 32 open outwardly.

Figure 1:
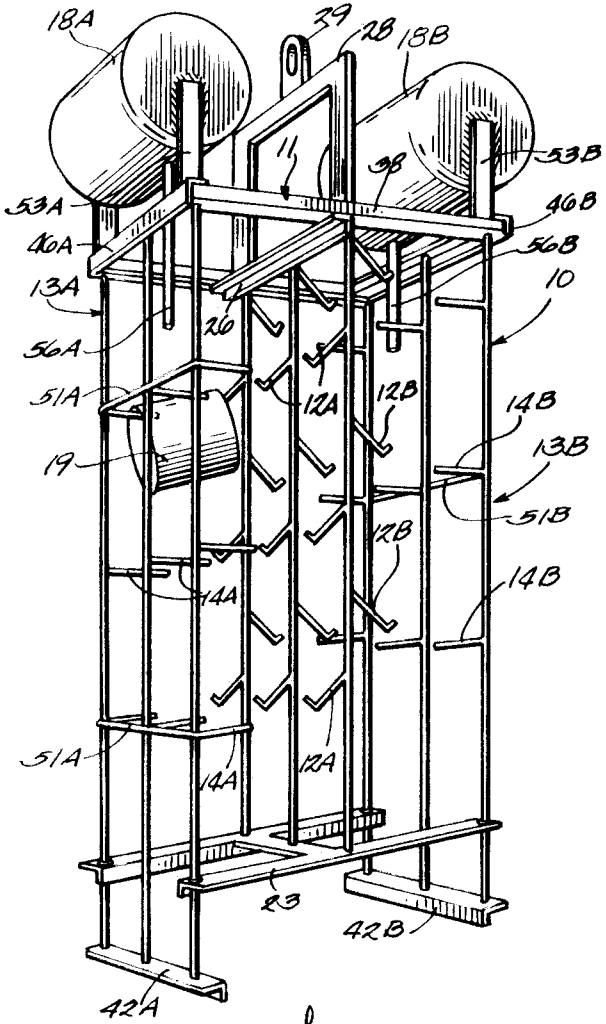
FIG. 1 is a perspective view of one embodiment of a hanger according to the present invention.

Slideable frames 13A, 13B each comprise a pair of upper and lower, horizontally extending beams 41A, 41B and 42A, 42B, rigidly secured together by respective rows of three vertically extending rods 43A, 43B. Upper beams 41A, 41B are L-shaped in cross section, and each include respective vertical walls 46A, 46B and horizontal walls 47A, 47B which extend inwardly (relative to the geometric center of the hanger) from the respective upper edges of walls 46A, 46B. Upper end portions of rods 43A, 43B are rigidly secured to respective lower faces of horizontal walls 47A, 47B at intervals along the length of beams 41A, 41B. Lower beams 42A, 42B similarly are L-shaped in cross section and comprise respective horizontal walls 48A, 48B and vertical walls 49A, 49B. Rods 43A, 43B are rigidly secured to respective upper faces of horizontal walls 48A, 48B. Rods 43A, 43B have rows of respective horizontal, inwardly extending support pins 14A, 14B secured thereto. Each of rods 43A, 43B opposes a corresponding rod 24 to define appropriately positioned opposing pairs of proximal pins 12A, 14A and 12B, 14B, as shown in FIG. 1. Frames 13A, 13B may further include one or more reinforcing crossbars 51A, 51B rigidly secured to each of rods 43A, 43B respectively. Crossbars 51A, 51B are conveniently located along the length of rods 43A, 43B at positions corresponding to rows of pins 14A or 14B.

Flotation devices 18A, 18B are secured to respective upper surfaces of walls 47A, 47B respectively. Pairs of vertical end brackets 53A, 53B rigidly secure opposite end walls of respective hollow cylindrical tanks 54A, 54B to opposite end portions of walls 47A, 47B. The air-filled interiors of tanks 54A, 54B communicate with the surrounding atmosphere through respective downwardly extending open-ended tubes 56A, 56B. Tubes 56A, 56B prevent tanks 54A, 54B from exploding when hanger 10 and workpieces 19 are transported from an electrocoating bath into an oven to dry the painted workpieces 19.

Figure 4:
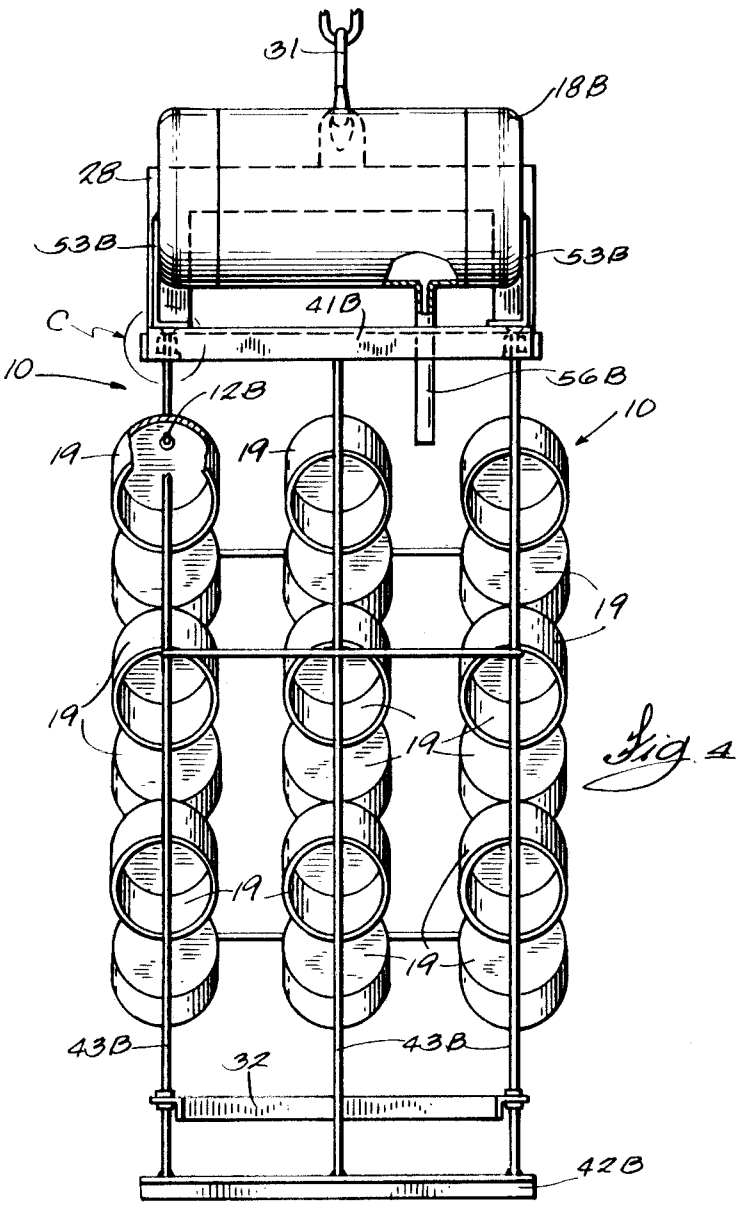
FIG. 4 is a side view of the hanger shown in FIG. 3.
Figure 3:
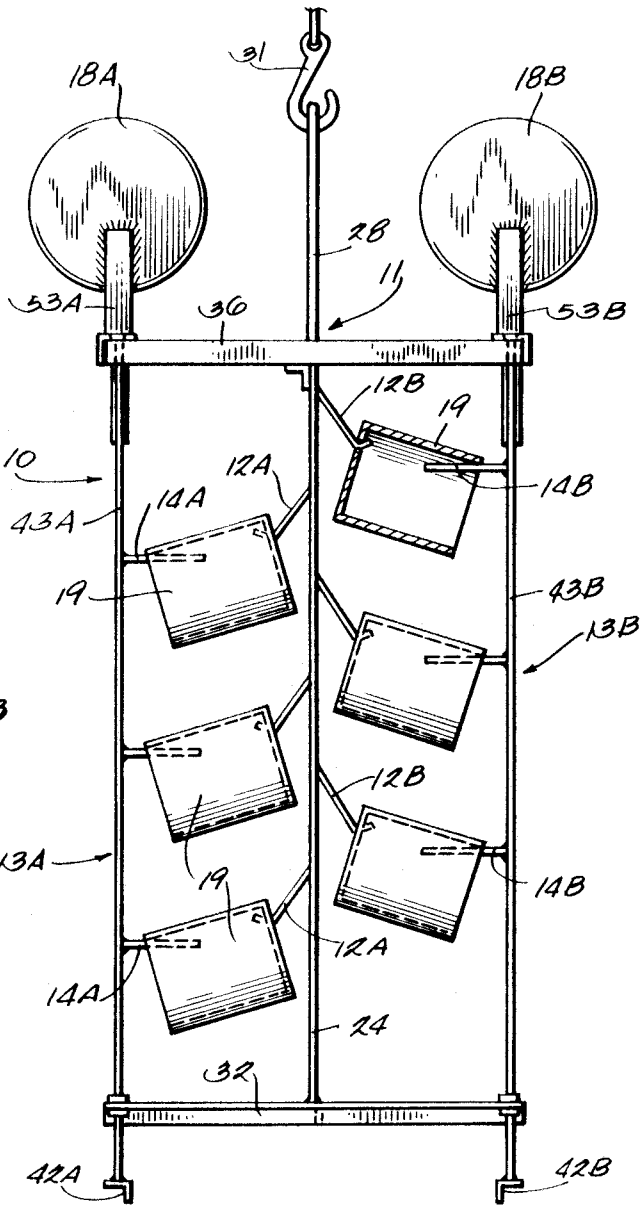
FIG. 3 is a front view of the hanger shown in FIG. 1 including partially broken away can-shaped workpieces supported on the hanger.

As illustrated in FIGS. 3 and 4, workpieces 19 comprise cylindrical cans open at the tops thereof and having small holes 61 in the bottoms thereof. For such workpieces 19, pins 12A, 12B preferably have respective upturned ends (hooks) 62A, 62B which are conveniently inserted through holes 61 of workpieces 19. Pins 12A, 14A support one set (series of rows) of workpieces 19 between central frame 11 and slideable frame 13A. Pins 14A extend into the open top ends of workpieces 19, and upturned ends 62A of pins 12A extend through holes 61 to support each workpiece 19 at the rear thereof. Pins 14A are disposed slightly lower than the corresponding opposing pins 12A so that workpieces 19 tilt downwardly when the hanger is in the position shown in FIG. 3.

Pins 12B, 14B support a second set of workpieces 19 between central frame 11 and slideable frame 13B in the same manner as sets of pins 12A, 14A. Since pins 12A, 12B extend alternately from each of rods 24, workpieces 19 of the second set are vertically offset relative to workpieces 19 of the first set, as shown in FIGS. 3 and 4.

Figures 5, 6, 7:
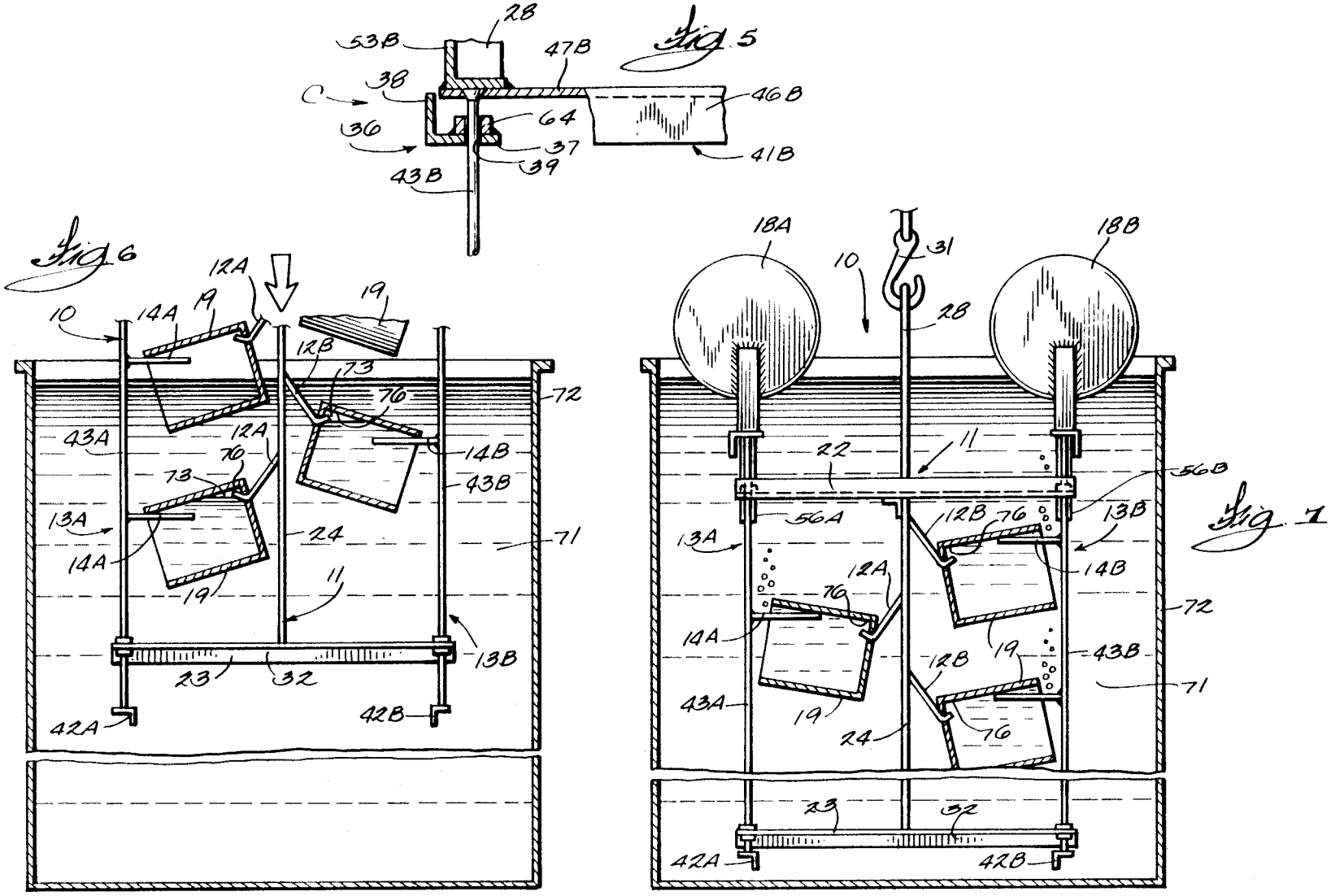
FIG. 5 is an enlarged cross-sectional view of the bearing assembly circled in FIG. 4.
FIG. 6 is a partial front view of the hanger shown in FIG. 3, showing the hanger being lowered into a paint bath.
FIG. 7 is a further front view of the hanger shown in FIG. 3 lowered almost completely into the paint bath.

FIG. 5 shows in detail the bearing assembly of circled portion C in FIG. 4. One rod 43A extends through hole 39, which has a diameter slightly greater than the diameter of rod 43A. A reinforcing ring 64 may be welded to the upper surface of wall 37 in order to reinforce the bearing surface between rod 43A and transverse beam 36. The seven other bearing assemblies of hanger 10 corresponding to other rods 43A, 43B in corner positions are substantially the same as assembly C, except that the relative positions of certain parts are altered in accordance with the geometry of the device.

Referring now to FIGS. 6 and 7, hanger 10 according to the present invention operates as follows. As shown in FIG. 6, hanger 10 loaded with workpieces 19 is initially lowered into an electrically charged paint bath 71 confined in a paint tank 72. Air pockets 73 form in portions of the can-shaped workpieces 19 from which air is unable to escape. Slideable hanger 13A, 13B rest in a lowermost position (upper beams 41A, 41B abut against H-shaped frame section 22, which acts as stop means). Lower beams 42A, 42B are spaced apart from lower H-shaped frame section 23.

FIG. 7 illustrates how hanger 10 removes trapped air bubbles 73 when hanger 10 is almost entirely immersed in paint bath 71. Air held inside tanks 54A, 54B of respective flotation devices 18A, 18B lifts slideable frames 13A, 13B relative to central frame 11 when flotation tanks 54A, 54B reach the position at the surface of paint bath 71 shown in FIG. 7. Since central frame 11 is not supported from above by a flotation device, it continues to descend vertically down into paint bath 71. Slideable frames 13A, 13B do not continue to descend in this manner due to flotation devices 18A, 18B, thus producing the relative sliding movement of slideable frames 13A, 13B relative vertical to central frame 11. Such movement continues until central frame 11 reaches a lowermost position whereat lower H-shaped frame section 23 (which acts as second stop means) abuts against lower beams 42A, 42B of slideable frames 13A, 13B. As shown in FIG. 7, pins 12A, 12B move downwardly relative to corresponding pins 14A, 14B so that workpieces 19 now tilt upwardly, allowing air from air pockets 73 to escape as air bubbles. Portions 76 of workpieces 19 which remained unpainted due to the presence of air pockets 73 thereby become painted.

Hanger 10 is now lifted (by eye 29, hook 31) so that it resumes the position shown in FIG. 6, i.e. central frame 11 is raised until it engages beams 41A, 41B and thereby lifts frames 13A, 13B out of paint bath 71. Workpieces 19 return to downwardly tilted positions as shown in FIG. 6, such that excess paint effectively drains out of each workpiece 19. Hanger 10 is then completely removed from paint bath 71 and sent into an oven for baking the painted workpieces. In the oven, tubes 56A, 56B allow air to escape from tanks 54A, 54B.

The embodiment of a hanger according to the invention illustrated above includes a pair of slideable frames solely for the purpose of providing symmetry and balance to the hanger assembly. A single slideable frame 13 could be employed if the means for connecting the hanger 10 to the overhead conveyor system (including vertical frame section 28, eye 29) is suitably modified.

A variety of means other than a flotation device can effect relative movement between the slideable frame and the frame connected to the overhead conveyor system. For example, flotation devices 18A, 18B can be omitted, and slideable frame 13A can be raised manually when hanger 10 has reached a desired position within paint bath 71. However, the use of a flotation device such as an air-filled tank as in the illustrated embodiment has proven highly advantageous in practice.

Each of the frames in the illustrated embodiment (central frame 11, slideable frames 13A, 13B) are advantageously assembled by welding to define the described rigid frame structures. Hanger 10 according to the invention can be readily manufactured by first assembling central frame 11, then positioning rods 43A, 43B through holes 39, and then welding rods 43A, 43B to upper and lower beams 41A, 41B and 42A, 42B. Once thus welded, slideable frames 13A, 13B are permanently mounted to central frame 11, but can be slideably moved relative to central frame 11 between a lowermost position as shown in FIG. 1 and an uppermost position as shown in FIG. 7. For purposes of electropainting, hanger 10 is preferably fabricated entirely of electrically conductive metal parts.

It will be understood that the above description is of the preferred examplary embodiments of the present invention, and that the invention is not limited to the specific forms shown. Modifications may be made in the design and arrangement of the elements without departing from the spirit of the invention as expressed in the appended claims.

What is claimed is:

1. A hanger, comprising:

an elongated support frame having a plurality of arms extending therefrom;

an elongated movable frame mounted on said support frame for lengthwise movement relative to said support frame, said movable frame having a plurality of arms extending therefrom and being positioned to allow a plurality of objects to be supported on said hanger, each of said objects being supportable by a pair of one of said arms of said support frame and one of said arms of said movable frame;

stop means for limiting movement of said movable frame to a lowermost position relative to said support frame; and a hollow tank secured to an upper end portion of said movable frame for lifting said movable frame relative to said support frame when said hanger is lowered into a liquid bath, and tilting said objects supported on said pairs of arms, said tank having a ventilation tube for preventing said hollow tank from exploding when said tank is heated.

2. The hanger of claim 1, wherein said arms of said movable frame and said support frame comprise elongated pins.

3. The hanger of claim 2, wherein said support frame further comprises a plurality of parallel rods having a series of said pins extending thereform, and upper and lower frame sections rigidly uniting said parallel rods of said support frame at opposite ends thereof.

4. The hanger of claim 2, wherein said movable frame further comprises a plurality of parallel rods having a series of said arms rigidly secured along the length thereof, and upper and lower crossbeams rigidly uniting said rods of said movable frame at opposite ends thereof.

5. The hanger of claim 4, wherein said rods of said movable frame extend through holes in said upper frame section of said support frame, and said upper crossbeam interlocks said movable frame with said support frame.

6. The hanger of claim 1, wherein said stop means further comprises a horizontal wall of said upper frame section of said support frame.

7. The hanger of claim 1, further comprising second stop means limiting lengthwise movement of said movable frame to an uppermost position relative to said support frame.

8. A hanger, comprising:

a support frame including an elongated rod;

a first movable frame mounted on said support frame, wherein said movable frame comprises an elongated rod;

first means including a plurality of pins secured to said rod of said support frame for supporting a plurality of objects;

second means connected to said movable frame for supporting said objects in cooperation with said first supporting means, wherein said second supporting means comprises a plurality of pins secured to said rod of said movable frame, and said pins of said first supporting means and said pins of said second supporting means are positioned in opposing pairs for supporting each one of said objects at opposite ends thereof; and means for effecting movement of said movable frame relative to said support frame and of said second supporting means relative to said first supporting means.

9. The hanger of claim 8, further comprising:

a second movable frame mounted on said support frame opposite said first movable frame, wherein said pins of said first supporting means extend alternately in opposite directions from said rod of said support frame to define two sets of opposing pins with said first and second movable frames; and means for effecting movement of said second movable frame relative to said support frame substantially in unison with said first movable frame.

10. A hanger, comprising:

a support frame including an elongated rod;

a movable frame mounted on said support frame, wherein said movable frame comprises an elongated rod;

first means including a plurality of pins secured to said rod of said support frame for supporting a plurality of objects;

second means connected to said movable frame for supporting said objects in cooperation with said first supporting means;

means for effecting movement of said movable frame relative to said support frame and of said second supporting means relative to said first supporting means, including a hollow tank secured to said movable frame and means for ventilating said hollow tank and preventing said hollow tank from exploding when said tank is heated.

* * * * *